US006837809B2

(12) United States Patent
Majumdar

(10) Patent No.: US 6,837,809 B2
(45) Date of Patent: Jan. 4, 2005

(54) PRACTICE DEVICE FOR A BASEBALL PITCHER

(76) Inventor: Ramendra Nath Majumdar, 2549 North Rd., Hudson, OH (US) 44236

( * ) Notice: Subject to any disclaimer, the term of this patent is extended or adjusted under 35 U.S.C. 154(b) by 0 days.

(21) Appl. No.: 10/385,145

(22) Filed: Mar. 10, 2003

(65) Prior Publication Data

US 2004/0180736 A1 Sep. 16, 2004

(51) Int. Cl.[7] ..... A63B 69/00

(52) U.S. Cl. ..... 473/454; 473/422; 473/434; 473/435; 273/348; 273/407

(58) Field of Search ..... 473/454, 422, 473/446, 456, 434, 469, 470, 471, 468–478; 273/348, 407, 410

(56) References Cited

U.S. PATENT DOCUMENTS

| | | | | | |
|---|---|---|---|---|---|
| 1,175,692 | A | * | 3/1916 | Boicourt | 273/378 |
| 1,567,384 | A | * | 12/1925 | Rectenwald et al. | 473/456 |
| 3,516,675 | A | * | 6/1970 | Gregory et al. | 473/164 |
| 4,093,218 | A | * | 6/1978 | Burchers | 473/435 |
| 4,344,621 | A | * | 8/1982 | Baker | 473/446 |
| 4,415,154 | A | * | 11/1983 | Engelhardt | 473/456 |
| 4,473,227 | A | * | 9/1984 | Klaus | 473/454 |
| RE32,842 | E | * | 1/1989 | Wigoda | 473/467 |
| 4,830,369 | A | * | 5/1989 | Poitras | 473/455 |
| 5,993,334 | A | * | 11/1999 | McNamara | 473/446 |
| 6,113,507 | A | * | 9/2000 | Padilla | 473/478 |
| D438,910 | S | * | 3/2001 | Culberson | D21/303 |
| 6,250,634 | B1 | * | 6/2001 | Strain et al. | 273/395 |
| D462,733 | S | * | 9/2002 | Smith, IV | D21/780 |
| 6,554,284 | B2 | * | 4/2003 | Chou | 273/371 |

* cited by examiner

*Primary Examiner*—Mitra Aryanpour
(74) *Attorney, Agent, or Firm*—Alfred D. Lobo

(57) ABSTRACT

A passive pitching target comprises a portable device including a resilient rectangular laminar backstop indentable by a baseball pitched at a velocity of 100 km/hr (62 mph); the target is higher than it is wide, and rests with its base supported on the ground; one planar face of the backstop is fully covered with a laminar resilient pad of synthetic resinous material having a specified resilience to ensure that a pitched baseball striking the target's planar surface is returned to the pitcher at a location of choice, either less than one-half the distance from where the pitch was thrown, to mimic a "bunt", or, in the general vicinity of the location from where the ball was pitched; the pad is dimensioned for height and width the same as the backstop and is removably affixed in contact with the face of the backboard; the resilient pad, in turn is fully covered with a removably affixed synthetic resinous sheet of material overlying the resilient pad and in intimate contact therewith, the target forming an indentable laminate; a strike zone is visually identified on or through the overlying sheet depending upon whether the sheet is transparent.

9 Claims, 5 Drawing Sheets

PRACTICE DEVICE FOR A BASEBALL PITCHER

FIELD OF THE INVENTION

This invention relates generally to a baseball pitching target functioning as a practice or training device, which returns a pitched baseball to a predetermined distance from the target, by virtue of the choice of the physical properties of three resilient structural members having a combined resilience chosen to provide that distance; and the target has a planar face which is presented to the pitcher at an obtuse angle in a narrow range; the target has no moving parts, no sensors or computing means connected thereto, has no ball collection means and is incapable of providing a score.

BACKGROUND OF INVENTION

The invention is narrowly directed to help a baseball pitcher choose and use the most basic training device rather than choosing one of numerous pitching targets which provide indicia of accuracy or scoring, or choosing a device which uses a net or a canvas attached to a rectangular frame.

Devices for scoring pitches are generally directed to fill special needs, serve a specified narrow purpose, are too complicated for use by a typical youngster bent on honing his pitching skill, and too expensive to purchase and to maintain. Most popular among passive devices which do nothing more than attempt to return, deflect or stop a ball pitched onto a target area, is a net or a canvas either held directly in a frame, usually rectangular, or by plural springs provided with a back support; preferably the ground-contacting portion of the frame is anchored to the ground by plural stakes and not free-standing.

The problem with using a net is that the velocity and direction of return of the ball is highly variable depending on how close to the frame the net is struck by the ball. The variation in the angle of return is exaggerated when the face of the net is tilted at an obtuse angle, with the result that the ball is seldom returned to the vicinity of the pitcher. Moreover, a ball striking the frame careens off unpredictably, thus jeopardizing the safety of bystanders. Though the basic, simple, net or canvas tilted at an obtuse angle could be constructed of heavy duty materials held in a rigid frame by plural springs able to withstand repeated impacts of a baseball, the variability of rebound caused by loosening of the springs and net after multiple impacts is as unavoidable as it is undesirable because it shortens the useful life of the device.

The goal is to provide an unobviously simple, durable, passive, planar, solid target which is light-weight so as to be portable and stowable; which is not a net yet fulfills the needs of a lone pitcher practicing with a limited supply of baseballs, typically in the range from 1 to 5, so that with a large enough target resting directly on the ground, the time spent chasing pitched balls is limited only to those balls which entirely miss the target. In one embodiment all pitches hitting the target are returned in the general vicinity of the target, mimicking a "bunt", irrespective of where they strike the target. In another embodiment, the goal is to provide a target which strives to return a pitch striking any portion of its surface at a velocity of at least 100 Km/hr (62 mph), to a zone in the general vicinity of the pitcher, "strikes" being returned closer to the pitcher by virtue of the smaller reflected angle (relative to the horizontal) from the strike zone than a pitch in the upper periphery of the target around the strike zone; alternatively, by choice of the resilience of materials used in the strike zone and in the peripheral zone, a "ball" may be returned closer to the pitcher than a "strike"; and, using each embodiment of the invention, the surface of each returned ball bears no visually noticeable damage due to its impact on the target. It is essential that the entire practice device be an essentially weatherproof, easily portable composite which is stowable in the trunk of an automobile referred to as a "compact", and weighs in the range from 5–15 Kg (11–33 lb); and despite its light weight militating against maintaining a fixed position when struck with a ball pitched at a velocity in the range from about 100 km/hr (62 mph) to about 160 km/hr (99 mph), the target with a minimum of support structure is to remain stable and immovable in use.

When the resilience of the resilient pad is low as measured by ASTM D1667, pitches are returned as bunts; when the resilience of the pad is relatively higher so as to complement the rebound imparted by a cover sheet tightly tensioned across it, pitches are returned as infield hits. In each case, the pad being backed by a relatively thin, indentable, impact-resistant backstop with defined flexibility, a ball pitched against the resilient pad at a velocity in excess of about 100 km/hr (62 mph) makes a momentary indentation (hence "indentable") in all three components, the cover sheet, the pad and the backstop. Though such an indentation is minimal relative to the indentation made in a net adapted to return a baseball pitched at the same speed, the combination of physical properties of each structural component and indentation of all three, together with the angulation of the target's surface, is sufficient to bias the return vector (representing the ball) towards the central horizontal axis so as to "serve" the pitch to a chosen location in front of the pitcher. Over a distance of about 18.3 meters (60 feet) the biased return vector delivers the ball closer to the pitcher than the reflected vector.

When the resilient pad is a composite of two pads having markedly different resilience, one central pad dimensioned to correspond to the strike zone and the other pad for the peripheral zone, the pitcher can get a physical confirmation of a strike by choosing the appropriate resilience of each of the pads. The returned distance of a "strike" may be less than or greater than that of a "ball" depending upon whether the choice of the resilience of the central pad, which resilience determines the rebound of the ball, is higher or lower than that of the peripheral pad.

U.S. Pat. No. 3,001,790 to Pratt teaches a simple practice device for a baseball pitcher using a target of wood, plastic, metal or concrete panels, the central panel of the target being vertical and planar, and beveled peripheral panels around the central panel being angulated so that a pitch is returned in a direction dictated by the angle of the panels, only pitches in the central panel being returned along a path towards the pitcher.

The foregoing '790 patent was an improvement upon an earlier relatively complicated practice device disclosed in U.S. Pat. No. 2,162,438 to Letarte, in which plural panels rebound a pitched ball in various directions, the panels imparting different rebounds to balls in accordance with the speed at which each panel is struck, and depending upon which panel is struck. Angulation of a central panel which is covered with resilient material is adjustable so as to present a face at an obtuse angle. Angulation of hinged panels is controlled by an elaborate support structure. The panels may be constructed of wood, metal or other suitable material which will impart a substantial rebound to the ball but there is no enabling disclosure to help choose what physical properties might be critical to provide a particular rebound, namely sufficient to return the ball to a zone in the general vicinity of the pitcher. Recognizing that a concrete surface will provide a baseball pitched against it with substantial rebound, there is no suggestion that the material of choice might itself be resilient enough to be indentable by a baseball striking the material's surface at a velocity of at least 100 km/hr (62 mph). That the material itself is rigid is implicit from the disclosure that the panels are covered with a resilient material to provide the requisite rebound, e.g. a sheet of rubber which is of sufficient thickness to impart rebound to the baseball at a comparatively fast speed when thrown against the target; and again there is no teaching to enable one to find a suitable sheet of rubber, or its thickness, for the specified purpose, or the manner in which it is overlaid on the suitable material, without undue experimentation.

Further, the accuracy of a pitch to the '438 device is determined automatically by the nature of the rebound of the ball, that is, by the angular direction of a returned ball, since the strike zone is fixed by the choice of size of the central panel. Moreover, metal hinges for the panels interfere with the angle of return of the baseball even after their usefulness is impaired by repeatedly being struck by a baseball; and though the stability of the several panels relies upon the size of the large panels which stand at the same height as the batter, the stability is compromised because the lower edges of the panels are not supported on the ground. Much as the '790 patent sought to eliminate the complexities and disadvantages of the '438 invention, and presumably its expected heavy weight, the use of man-made materials not available in nature, in the invention disclosed herein, which materials have the physical properties specified, seeks to improve on the invention disclosed in the '790 patent.

SUMMARY OF THE INVENTION

A passive pitching target, suitable for use by a lone pitcher, comprises a portable and trunk-stowable device including a resilient rectangular laminar backstop indentable by a baseball pitched at a velocity of 100 km/hr (62 mph) ("pitch-indentable"); the target is higher than it is wide, and rests with its base supported on the ground; one planar face of the backstop is fully covered with a soft readily indentable laminar resilient pad of synthetic resinous material having a specified elasticity and resilience, specified to cushion the pitched baseball striking the target's planar surface to return it to a desired location in the range from about 2 m (6.56 ft) to about 15 m (49 ft), and to return it to a location in the range from about 2 meters (6.56 ft) to 5 meters (16.4 ft) from the target, mimicking a "bunt"; the pad is dimensioned for height and width the same as the backstop and is optionally removably or fixedly secured, preferably glued, in contact with the face of the backboard; the thin resilient pad and a portion of the rear surface of the backstop are preferably enveloped in a removably affixed synthetic resinous cover sheet of resilient material tightly stretched and overlying the resilient pad in intimate contact therewith, the three components forming an indentable laminate; a strike zone is visually identified on or through the overlying sheet depending upon whether the sheet is transparent; the strike zone has an area which may be changed to accommodate the need of a pitcher without changing its width; overlapping strike zones for batters of different height are provided for convenience; the area of the target itself is fixed and large enough to return a reasonably errant pitch; and the backstop is braced against the ground, both with its lower edge against the ground, and with a brace wide enough to prevent the light-weight target from being repositioned when the target is struck in either one of its upper comers; the brace includes a pair of interconnected elongate support members (or legs) connected with hinges directly to the rear of the backstop and otherwise unconnected to the backstop; the legs are dimensioned so as to present the planar face of the strike zone at an obtuse angle θ to the ground (which lies in the horizontal plane), the angle being in the range from 100° to about 140°, preferably in the narrow range from 100° to 120° and when folded against the backstop, the legs extend no further than the bottom edge of the target for easy storage in an upright position against a wall; the simple support structure of the support member provides the requisite stability by bracing without any portion of the practice device being staked to the ground.

In a first embodiment, the resilient pad is a unitary rectangular pad of uniform thickness having a single resilience such that a "strike" pitched with a chosen velocity (say 100 km/br, 62 mph) against the strike zone is returned to substantially the same distance from the target as a ball pitched at the same velocity against the periphery of the strike zone, the angle of return, measured in the vertical plane, being essentially the reflected angle relative to the line of flight towards the target, unless modified by the physical properties of the resilient pad and backboard; specifically, a "strike" is returned the same distance from the target as a "ball", the angle of returns 1 and 2 relative to the normal at the face being different for each, (see FIG. 6) if each pitch is released from precisely the same location and in a substantially linear path, each angle being affected by the momentary shape of the curved surface generated by the indentability of the combination of the cover sheet, the resilient pad and the backstop so as to provide an inward bias to the return, toward the central horizontal axis of the target, that is, towards the pitcher. A "strike" delivered to the geometric center of the strike zone in a linear path from a height the same as the center of the strike zone will be returned along a reflected linear path modified by the contribution of the curvature of the surface of the momentary dent; any pitch delivered to any other portion of the target will also be returned depending upon the angle of incidence modified by the effect of the momentary indentation of the target at the location where it is struck. By changing the resilience of the resilient pad and the tension across the face of the resilient cover sheet, the distance to which a pitched ball is returned (the "returned distance") may be varied. A pad requiring a pressure of 13.8 KPa (2 psi) will return a 100 km/hr (62 mph) pitch less than one half the distance from the location where the pitch was delivered; another pad requiring a pressure in the range from 68.9–344.5 KPa (10–50 psi), will return a 100 km/hr (62 mph) pitch more than one half the distance from the location where the pitch was delivered.

In an analogous manner, the angle of return β, measured in the horizontal plane, is essentially the reflected angle relative to the line of flight towards the target, modified by the physical properties of the resilient pad and backboard, the angle of returns β1 and β2 being different for pitches in the strike zone and in the peripheral area, but also biased towards the central horizontal axis due to the momentary indentation caused by each pitch. Since the target is relatively narrow, the differences in the angle of return in the horizontal plane is of relatively minor concern and are therefore not shown.

The thickness and physical properties of the cover sheet and the extent to which it is tensioned, are critical in their effect on the ball returning capability of the combination of cover sheet, resilient pad and backstop, as well as the angle of return of the ball. However, neither the cover sheet's color, or any pattern on it, are material so long as at least one strike zone is visually defined on the cover sheet's exposed face. The physical properties of the combination of cover sheet, resilient pad and backstop are the same for each portion of the area of the target which functions as if it was a homogeneous laminate, and the strike zone is visually identified only. Since the angle of return of all pitches is biased towards the central horizontal axis of the target due to the momentary indentation of the target by a baseball pitched against it, the difference in accuracies between pitches is determined not so much by the angle at which each is returned but by visual observation of where the target was struck.

In a second embodiment of the target, the resilient pad is a composite of first and second rectangular pads, each having substantially the same thickness but different resilience and colors, the first pad providing the strike zone of desired dimensions, that is, constant width but desired height, and the second pad providing the peripheral target area; and the cover sheet is substantially light transmitting, preferably transparent. A baseball which has an impact in the strike zone ("strike") is visually seen to have been a strike; confirmation that it is a strike is decreed by the returned distance of the ball, which return distance may be chosen either to mimic a "bunt" or an "infield hit"; for example, a strike may be returned to a distance closer to the pitcher than one striking outside the strike zone, preferably in the range from about 25% to 50% closer to the pitcher than a "ball", because of the difference in combined resilience and deformations of the structural elements of the target. As before, the momentary indentability of the combination of cover sheet, each resilient pad (whether central or peripheral), and backstop, bias the reflected angle of the returned ball towards the horizontal central axis of the target.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

The problem referred to above is best addressed by specifying a large enough target with enough mass so as not to require anchoring to the ground yet being readily portable, that is, easily picked up and accommodated in a trunk of a typical "compact", the weight being no more 15 Kg (33 lbs), preferably in the range from 8–13 Kg (17.6–28.7 lb); further, by providing an inclined target with a combination of a resilient backstop to which a resilient pad is preferably attached with an adhesive, and a cover sheet to function as protection of the resilient pad secured to the backstop with screws driven through the backstop's rear surface. Alternatively, the cover sheet is made of stretchable rubber filled with carbon black, e.g. butyl rubber, and the marginal portions of the sheet are folded over and the corners secured so as to form a tightly stretchable slip-cover which, under tension, can be pulled over the pad and backstop, extending over the edges of the backstop where the periphery of the cover sheet is held in place by the backstop without any fastening means. In this manner, the resilient pad is detachably secured to the face of the backstop, eliminating the need for glue or other fastening means. Thus the cover sheet forms a deformable large planar spring, analogous to a trampoline, cushioned by the resilient pad, a ball pitched against the strike zone is returned within a zone relatively close to the pitcher. This "service" to the pitcher is due to an unexpectedly effective choice of the inclination of the face of the target, the flexural modulus (ASTM D 790) of the backstop, the resilience of the pad, the tensile strength and hardness of the cover sheet, and the use of only a pair of legs for support. The "service" is affected by the physical properties and the manner in which the resilient pad and backstop are overlaid with the thin cover sheet.

When the resilient pad is homogeneous and has a single resilience, the pitcher can visually check whether the pitch has struck a spot within the strike zone which is identified on or through the cover sheet. Though the resilient pad cushions the deformation of both the backstop and the cover sheet, the cover sheet in turn protects the resilient pad from damage due to the full impact of the baseball and from absorbing water if kept outside in the rain.

Figure 1:
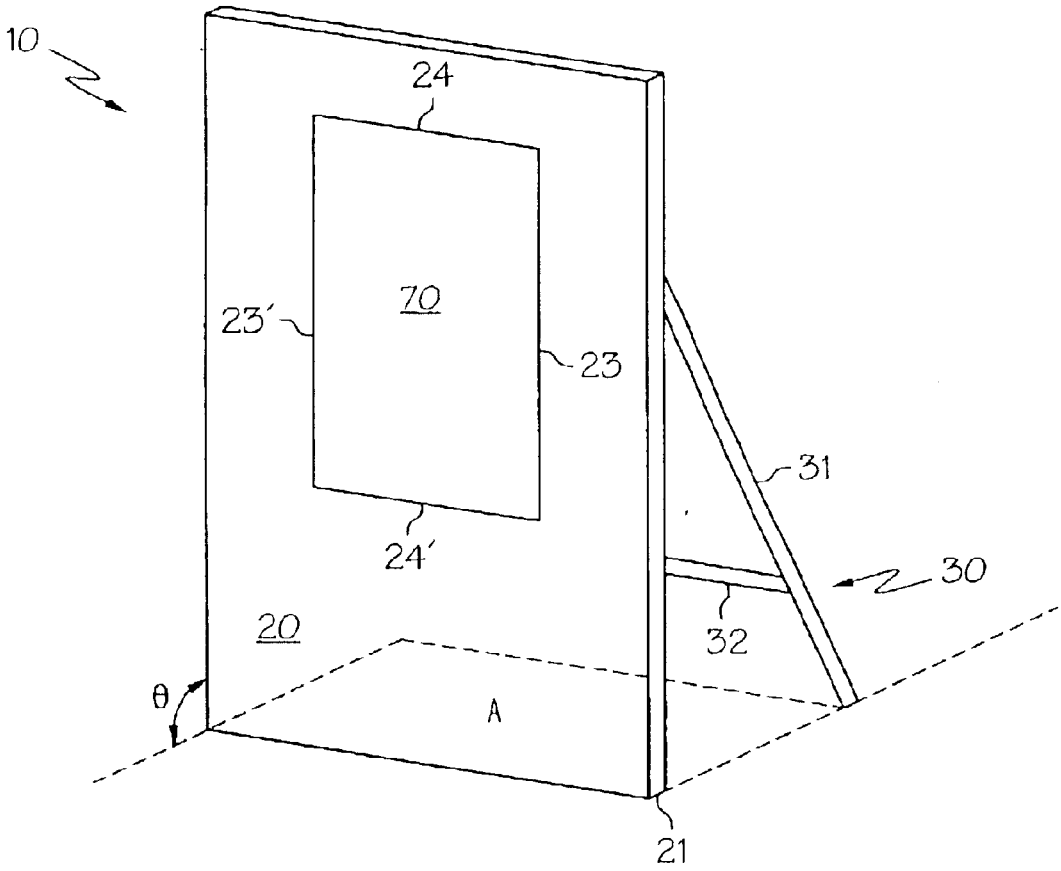
FIG. 1 is a front perspective view of the practice device, not to scale, resting on the ground.
Figure 2:
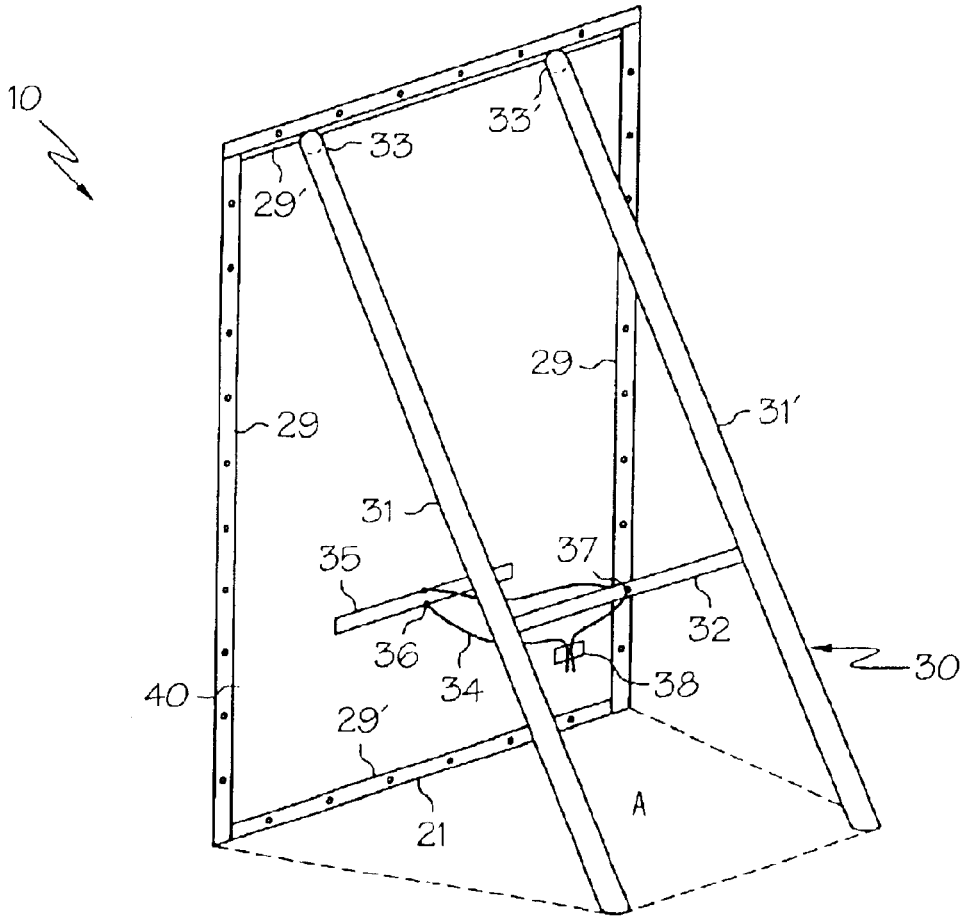
FIG. 2 is a rear perspective view, not to scale, illustrating the pitching device resting on the ground.
Figure 3:
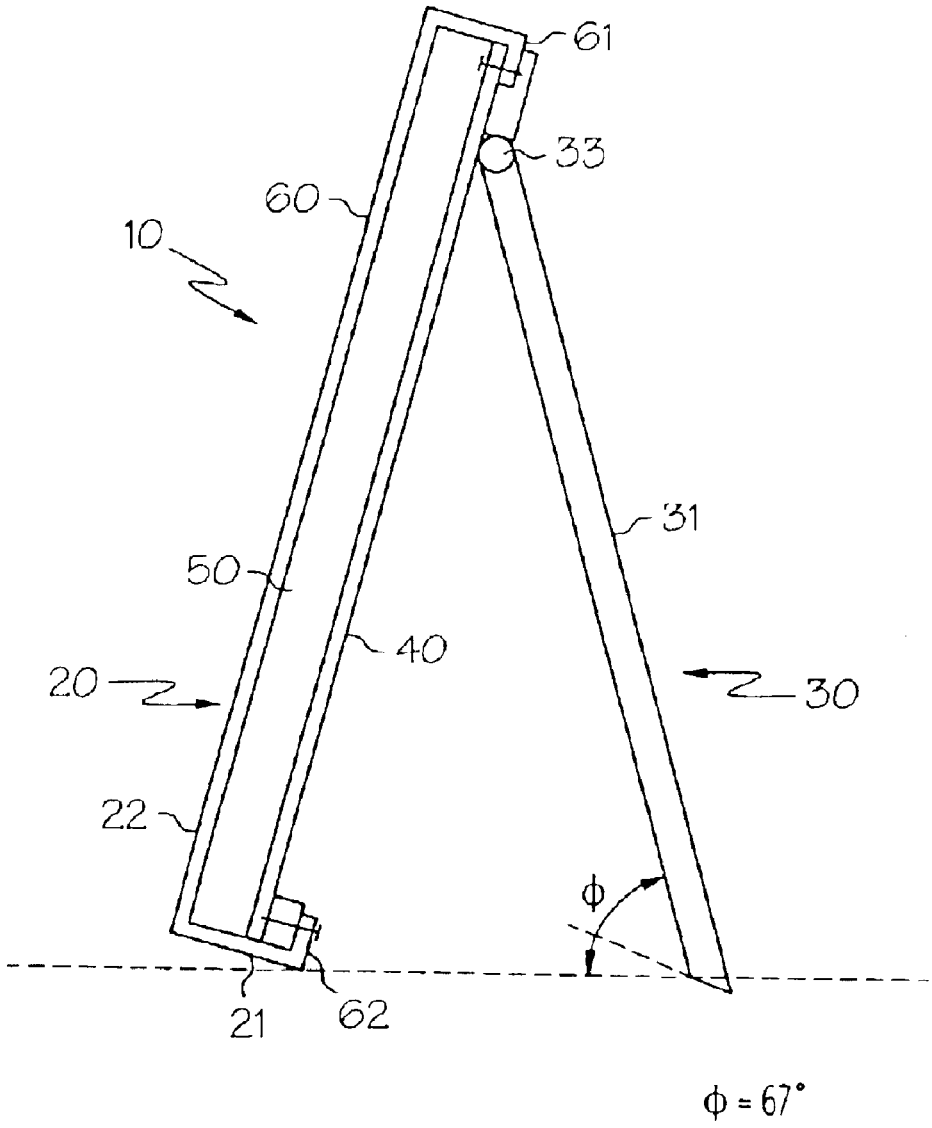
FIG. 3 is a side elevational view, not to scale, illustrating a cross-section of the target and its stabilizing support members.

Referring to FIGS. 1, 2 and 3 there is schematically illustrated the structure of the practice device identified generally by reference numeral 10, comprising a generally laminar rectangular target 20 and an adjustable support member 30 pivotably attached near the top, at the rear of the target 20 so that adjustability is restricted to a distance at which the laterally spaced apart feet of the support legs 31 and 31' connected by crossbar 32, may rest so as to define a stable support area A. The ground-contacting surface of the support structure has an angle $\Phi$ of approximately 67° for better stability while in the standing position. The dimensions of the target are such relative to the support member that the lower edge of the target 21 rests on the ground and the face 22 of the target 20 is presented at an obtuse angle $\theta$ in the preferred range from about 100° to 120° to the horizontal.

The target 20 comprises a resilient and indentable planar backstop 40 the face of which is fully covered with a resilient pad 50 which in turn is fully covered by a cover sheet 60, together forming a laminate indentable by a baseball pitched at 100 Km/hr. The thin backstop 40, less than 0.5 cm (0.2") thick, has a flexural modulus determined by ASTM D-790 in the range from about 60 to 11,000 MPa (8.7 to $1596.5\times10^3$ psi). The resilient pad 50 is a unitary rectangular pad of synthetic resinous material having a hardness in the range from about Shore OO 15–95 (ASTM D-2240), having a resilience measured as compressive pressure required to make an indentation 25% of the thickness of the pad, the pressure being in the range from 6.89–344.5 KPa (1–50 psi) and thickness in the range from about 0.2 cm (0.08 in) to about 4 cm (1.57 in), preferably of a homogeneous closed cell or open cell foam of an elastomer.

Referring to FIG. 3 illustrating a cross-sectional view of the target 20 of the practice device 10, the resilient pad 50 and the indentable laminar backstop 40 each have the same area with a width and length each at least 20% greater than the corresponding dimensions of a chosen maximum area of a strike zone. Preferably the backstop has a length (or height) no more than 1.52 meters (60 inches) and a width of 1.22 meters (48 inches) so as to fit in the trunk of a typical automobile. It is essential that (i) the backstop 40 be constructed from material able to withstand repeated impacts of a baseball traveling at a speed of up to 161 km/hr (100 mph) because of the cumulative damaging effect of such "ball-peening" despite the backstop being protected by the resilient pad 50 and enveloped by cover sheet 60, wrapped around the edges of the backstop; and (ii) that the weight of the practice device be limited for portability to 15 kg (33 lb), yet be heavy enough to remain stationary when struck by a high-velocity pitch. Upper and lower margins 61, 62 (side margins are not visible in this view) of the cover sheet are secured to the rear surface of the backstop 40.

This balance is achieved with a laminar rectangle of impact-resistant glass-fiber reinforced polyethylene having a flexural modulus in the range from about 1448 to 4136 MPa ($2.1\times10^5$ psi to $6\times10^5$ psi), or less desirably, by a correspondingly dimensioned piece of high density polyethylene (HDPE) sheet about 0.3 cm (0.125") thick having a flexural modulus of 69 MPa ($6\times10^5$ psi), to which is adhered the resilient pad 50.

As shown in FIG. 2, because it is essential that the practice device weigh less than 15 Kg (33 lb) to be easily portable and stowable in an automobile characterized by the term "compact", only a single pair of support legs 31, 31' is used. However, they are positioned so as to provide a wide enough base A to counteract a force generated by a pitched baseball striking a corner of the target, or any location within the target. Minimum necessary support is provided when the distance between lines through the two legs 31, 31' and the bottom of the target is at least one-half the width of the target.

Most preferred to provide the requisite support area is a pair of inextensible elongated rigid struts 31 and 31' interconnected with a crossbar 32, functioning as twin support members, each pivotably connected to the rear of the backstop, near each side thereof and its upper edge, with hinges 33, 33'. The length of each leg is such that when the legs contact the ground along a line parallel to and laterally spaced apart relative to the lower edge of the backstop, the face of the target is presented at an obtuse angle of 110°; the further away the spaced apart parallel line through the feet of the legs in contact with the ground, the greater the angle θ. The desired angle at which the face is supported is a function of the speed at which the pitcher expects to pitch the baseball, the height of the pitcher, and the distance of the pitcher from the target. No means for locking the legs 31, 31' in position is normally necessary, the geometry of the support means being such as to make locking the legs unnecessary when the device rests on grass or sand. Locking may be necessary to prevent slippage if the device 10 is placed on a relatively low-friction surface, such as a cemented or other smooth surface. A convenient locking means includes a short strut 35 secured to the rear surface of backstop 40, the strut having a vertical through-bore 36 in its mid-portion, through which through-bore 36 a cord 34 is passed (see FIG. 2); the cord is also passed through a passage 37 in crossbar 32, and the ends of the cord secured with a locking means 38 so as to restrict movement of the legs 31, 31' away from the lower edge of the target. Alternatively, a locking strut (not shown) may be used to provide a locking function by securing opposed ends of the locking strut to the strut 35 and crossbar 32 respectively.

Referring more particularly now to FIG. 3 there is illustrated the cover sheet 60 providing the face 22 of the rectangular target 20; the resilient pad 50 is covered with the cover sheet 60 of synthetic impact-resistant polymer having a thickness in the range from about 254 μm (micrometers) or 10 mils to 1524 μm (60 mils), in superimposed contact with the resilient pad. The cover sheet is transparent and the thickness of the sheet has no noticeable effect on either the angle or the distance of the rebound of the ball. Underlying the cover sheet is a unitary resilient pad, and the cover sheet overlaps the sides of the backstop for at least 2.5 cm (1 inch).

Reverting to FIG. 1, the strike zone 70 is outlined on the cover sheet by a first pair of vertical strips 23, 23' of 2.5 cm (1 inch) wide adhesive tape horizontally spaced apart so that the outer edges of the tapes are at a fixed distance of a standard strike zone, that is, 43.2 cm (17 inches); and a second pair of horizontal strips 24, 24' vertically spaced apart at a variable distance chosen by the pitcher to correspond with the height of the batter whose strike zone is to be defined. The strips are secured to the exposed outer face 22 of the cover sheet 60, and the color of the strips is chosen to contrast with that of the cover sheet (see FIG. 3).

Figure 4:
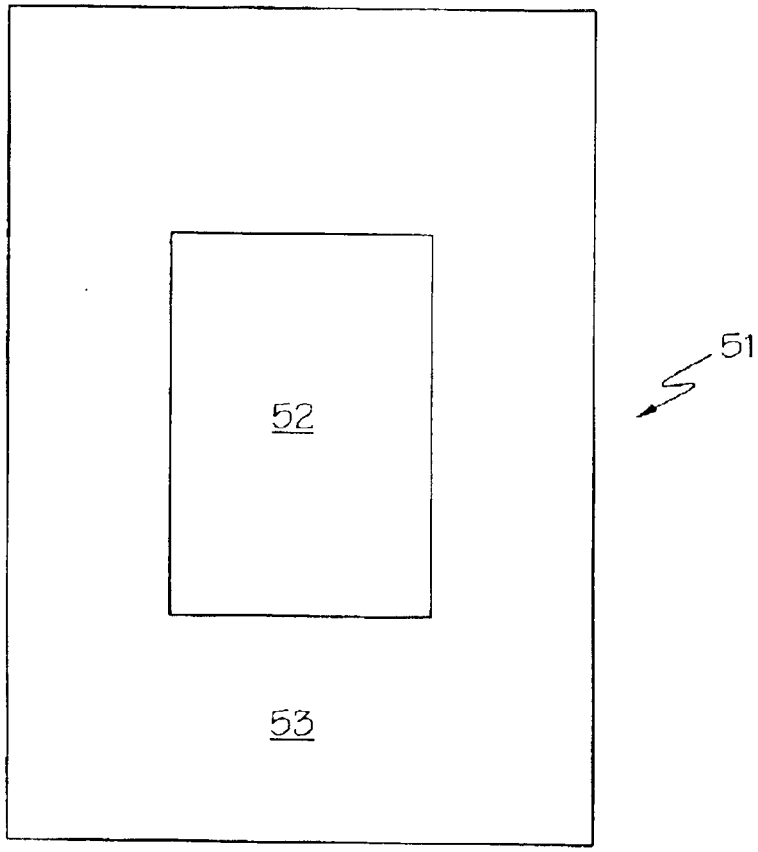
FIG. 4 is a front elevational view of a composite resilient pad, not to scale, in which the central portion defines a strike zone, and the peripheral portion defines a peripheral target zone, and the faces of the resilient pads are essentially coplanar.

Referring to FIG. 4 there is illustrated a composite resilient pad 51 comprising a central rectangular pad 52 corresponding in area to a strike zone of choice, and a peripheral pad 53 which snugly envelops the central pad so that the exposed faces of the pads are coplanar; the backstop (not visible, but behind the composite resilient pad) has the same area, as shown in FIGS. 1 and 2, and both the composite pad 51 and the backstop are covered by a transparent cover sheet (not visible). Either the central pad or the peripheral pad has a resilience greater than that of the other, this difference preferably being in the range from about 15% to 30%, so that a baseball pitched against the surface of one will be returned correspondingly further than a baseball pitched against the surface of the other. Preferably the central pad will have a higher resilience than the peripheral pad to reward the pitcher for accuracy.

Figure 5:
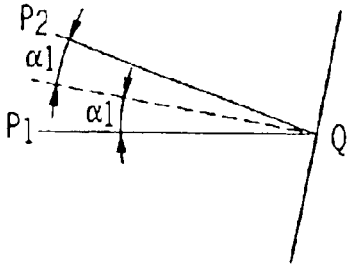
FIG. 5 is a partial vector diagram schematically illustrating the reflected angle of a baseball striking an angulated rigid backstop being substantially the same as the angle of incidence of the baseball.

Referring to FIG. 5, there is schematically illustrated the return path of a baseball pitched against the angulated surface of a rigid backstop which is too inflexible to be dented by a baseball pitched against it from point P1 directly in front of and laterally with respect to point Q in the center of the strike zone. The path of return is along the line to P2, the angle of reflection α1 relative to the normal at the point Q being the same as the angle of incidence α1.

Figure 6:
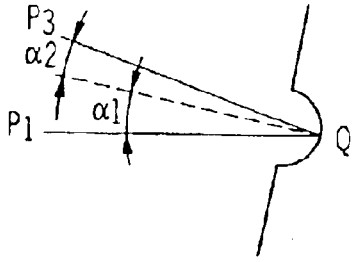
FIG. 6 is a partial vector diagram schematically illustrating the reflected angle of a baseball striking an angulated resilient and indentable backstop being substantially different from the angle of incidence of the baseball (the indentation is exaggerated in the drawing for illustrative purposes).

Referring to FIG. 6, there is schematically illustrated the return path of a baseball pitched against the angulated surface of a resilient flexible and indentable backstop which is dented by a baseball pitched against it from point P1 directly in front of and laterally with respect to the same point Q in the center of the strike zone. The path of return is along the line to P3, the angle of reflection α2 relative to the normal at the point Q being less than the angle of incidence α1 because of the contribution of the momentary curvature of the dented surface. The angle α2 being less, the flight of the returned ball is biased towards the path from P1 which corresponds to the horizontal central axis of the strike zone.

Figure 7:
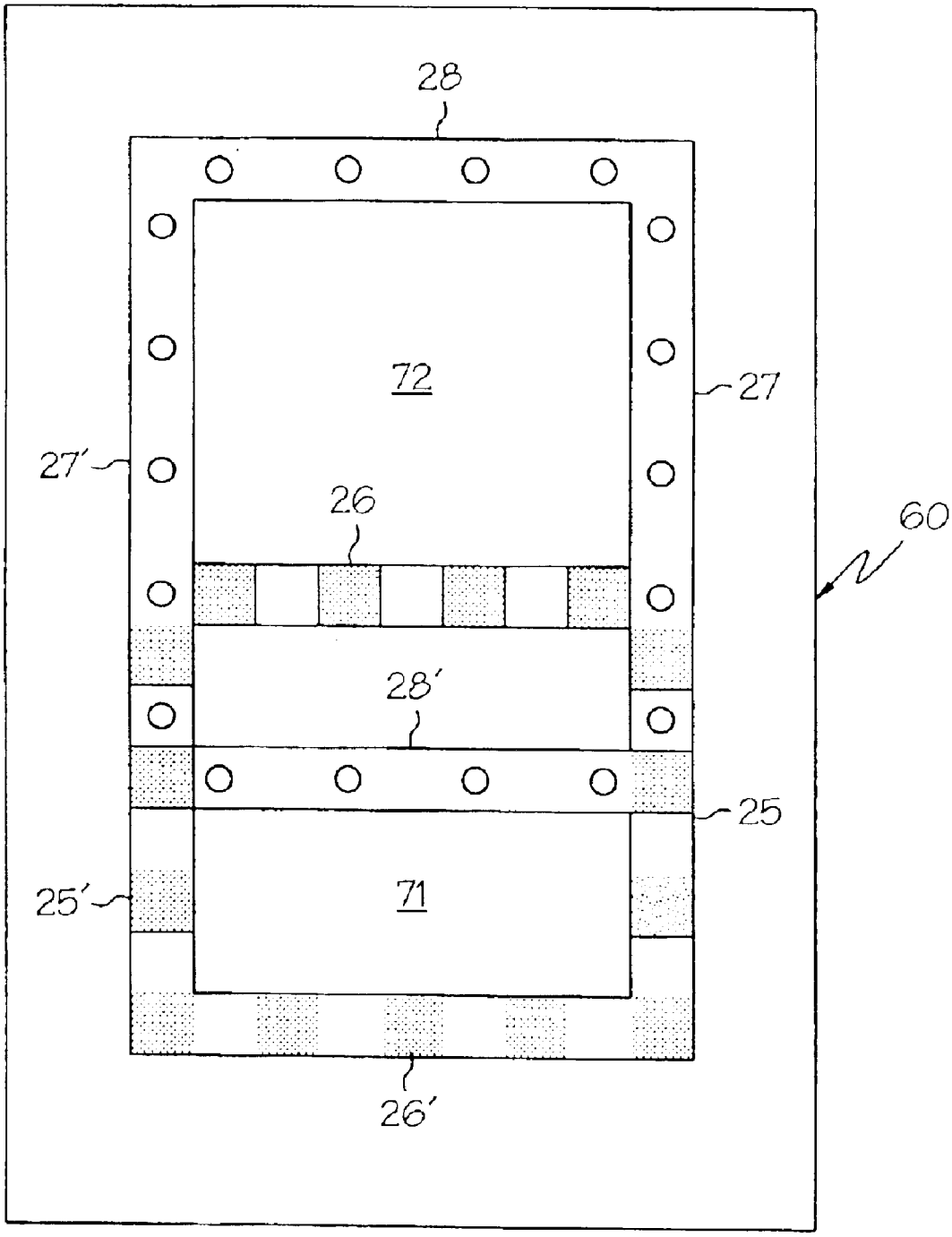
FIG. 7 is a front elevational view of a cover sheet, not to scale, on which overlapping strike zones are defined, one for a shorter batter, the other for a taller batter.

Referring to FIG. 7, there is illustrated a cover sheet 60 illustrating twin strike zones to avoid repositioning the tapes to practice for batters of different heights. A first strike zone 71 is defined by parallel spaced apart vertical and horizontal striped strips, 25, 25' and 26, 26' respectively, to correspond to the strike zone of a batter who is relatively short; and a second strike zone 72 is defined by parallel spaced apart vertical and horizontal dotted strips, 27, 27' and 28, 28' respectively, to correspond to the strike zone of a batter who is relatively tall. Though the upper portion of the strike zone 71 and the lower portion of strike zone 72 overlap one another, the strips 26 and 28' defining the overlap, each strike zone is visually clearly defined, differentiating a first strike zone from a second, so as to easily distinguish a strike or a ball for the relevant batter.

In the following illustrative example 1 a practice device is constructed to return a pitched ball as a "bunt", using the following structural elements:

EXAMPLE 1

A backstop is made from high density polyethylene (HDPE) sheet available from McMaster-Carr Supply Company ("McMaster"), the dimensions of the sheet being 122 cm (48")×94 cm (37")×0.32 cm (0.125"). To one face of the sheet is adhered a pad of white melamine foam having a density of 11.2 kg/cu meter (0.7 lb/cu ft) having a resilience measured as requiring 12 KPa (1.74 psi) to provide compression of 25% (also referred to as a 25% deflection). The pad is covered with a sheet of gray vinyl 1 mm (0.040") thick with the margins of the sheet being uniformly tensioned and secured around the periphery of the HDPE backstop, and a strike zone defined with white adhesive tape.

A support structure illustrated in FIGS. 1–3 is provided by rectilinear or cylindrical struts 29, 29' which may be of wood such as furring strips, each about 2.5 cm (1")×3.75 cm (1.5")×2 cm (0.75")×69 cm (27") long, or molded from a polyolefin such as polyethylene. The support structure is hingedly connected to the backstop, each leg with a metal hinge. The support legs are extended so as to support the face of the target at about 120°.

A standard Rawlings Official League baseball pitched from 18.287 meters (60 ft) against the strike zone at 100 km/hr (62 mph) is returned about 6.4 meters (21 feet) from the target; the same baseball pitched against the periphery of the target at the same speed is returned about the same distance from the target.

EXAMPLE 2

In this illustrative example 2, a practice device is constructed with the same structural elements as the device in example 1 above, except that the resilient pad is a composite pad comprising a central pad having dimensions of a chosen strike zone, and a coplanar peripheral pad contiguous with and surrounding the strike pad.

The central pad is cut from 1.25 cm (0.5") thick black colored Evalite ethylene vinyl acetate foam purchased from McMaster having a density of 32 Kg/cu meter (2 lb/cu ft) and requiring 34.5 KPa (5 psi) for 25% deflection.

The peripheral pad is cut from the same sheet of Melamine used in example 1, to leave a rectangular central aperture into which the central pad is snugly fitted. The dimensions of the peripheral pad are 122 cm (48")×94 cm (37").

A "strike" impacting the central pad is returned 84% further from the target than a "ball" pitched against the peripheral pad with the same velocity of 100 km/hr (62 mph).

EXAMPLE 3

The device is constructed in a manner analogous to that described in example 1 except the following resilient materials were used:

Resilient backstop: 0.236 cm×122 cm×94 cm (0.093"×48"×37") phenolic canvas (H-26000), flexural modulus 138 MPa ($20\times10^3$ psi), obtained from Schoen Insulation Services having Izod Impact Strength 123 N-m/m (2.3 ft-lb/in).

Resilient Pad: 0.95 cm (0.375") thick "Ultimate" rebound polyurethane foam from Leggett & Platt Inc.

Coversheet: 0.08 cm thick (0.031") commercial grade black Neoprene rubber purchased from McMaster-Carr Supply Company.

When the face of the target is at an angle of 120 degrees, a standard baseball (Rawlings Official League) pitched from 18.287 meters (60 ft) against the strike zone at 100 km/hr (62 mph) is returned about 3.4 meters (11 feet) from any location in the target.

EXAMPLE 4

Following rubber composition was mixed in a Banbury as described by Sandstrom in U.S. Pat. No. 4,443,279:

| Material | Stage | Parts Per Hundred Rubber |
|---|---|---|
| Isobutylene-isoprene rubber (Butyl) | 1 | 70 |
| EPDM | 1 | 30 |
| N-550 Carbon Black | 1 | 50 |
| Zinc oxide | 1 | 3 |
| Stearic acid | 1 | 1.5 |
| Hydrocarbon resin | 1 | 8 |
| Productive Second Stage | | |
| Sulfur | 2 | 2 |
| Mercaptobenzothiazole | 2 | 1.25 |
| Tetramethylthiuram disulfide | 2 | 1 |

The above compound was calendered into a 117 cm×91 cm×0.04 cm (46"×36"×0.015") sheet which was formed around a rectangular sheet appropriately dimensioned to yield a slip-cover of the cover sheet with its corners sealed, adapted to be fitted with a chosen tension (across the face of the cover sheet) over a resilient pad provided by a pad of 0.95 cm (0.375") Poron cellular polyurethane foam from Rogers Corporation, secured to a backstop provided by a glass fiber reinforced (40% by weight) polyethylene sheet 122 cm (48")×94 cm (37")×0.16 cm (0.063") having a flexural modulus of $87\times10^6$ MPa ($12.62\times10^3$ psi) and Izod impact strength of 213 N-m/m (4 ft.lb/inch) of notch. Since the cover sheet is not fastened to the backstop it is readily removed to change the resilient pad; as before, adhesive tape is used to re-define the strike zone, if necessary.

The support means is provided by a unitary "H-shaped" structure of molded polyolefin struts hingedly connected to the backstop.

When the face of the target is at an angle of 120° a standard baseball pitched from 18.3 meters (60 ft) against any location on the target at 100 km/hr (62 mph) is returned about 7.6 meters (25 ft) from the target.

What is claimed is:

1. A passive pitching device suitable for use by a pitcher pitching a baseball, comprising, a portable target to which is hingedly connected a support member;

the target including a rectangular free-standing laminate including a pitch-indentable laminar backstop having front and rear faces, a resilient pad disposable on the front face of the backstop, and a cover sheet of synthetic resin;

the target having height and width dimensions at least 20% greater than corresponding dimensions of a chosen strike zone and angularly disposed relative to the ground, with the laminate's lower edge in contact with the ground, and no dimension of the laminate greater than about 1.52 meters (60 ins);

the support member being pivotably secured to the rear of the target near the top thereof, including a pair of legs terminal portions of which, when folded against the backstop fail to extend beyond the lower edge thereof, the legs adapted to contact the ground at locations spaced apart from each other and spaced apart from each lower corner of the target;

the backstop being of a resilient flexible rectangle of man-made material, momentarily pitch-indentable by a baseball at a velocity of 100 km/hr (62 mph);

the backstop's exposed front face having removably secured thereto the resilient pad having the same height and width dimensions as the backstop, the pad's resilience being measured as compressive pressure required to make an indentation 25% of the thickness of the pad, the pressure being in the range from 13.8–344.5 KPa (2–50 psi) and thickness In the range from about 0.2 cm (0.08 in) to about 4 cm (1.57 in);

the resilient pad's exposed face being covered with the cover sheet having a thickness in the range from 254 $\mu$m to 1524 $\mu$m (10 mils to 60 mils), the cover sheet overlying the resilient pad in surface-to-surface contact with a predetermined tension so as to directly transfer force of the baseball impacting the cover sheet to the resilient pad and backstop;

the cover sheet having a visually identifiable strike zone thereon; and, the legs of the support member being adjusted to present the exposed face of the cover sheet of the target at an obtuse angle in the range from about 100° to about 140°;

whereby a baseball pitched against the target at a velocity of about 100 km/hr (62 mph) pitch-indents the backstop and is returned to a desired location in the range from about 2 m (6.5 ft) to about 15 m (49 ft) from the target without the target being moved from its location on the ground.

2. The device of claim 1 wherein the support member includes a pair of inextensible legs individually hinged to the backstop near the top thereof with hinges proximately disposed relative to each side of the backstop.

3. The device of claim 2 wherein the strike zone is defined by first and second pairs of elongate, flexible strips, one pair horizontal and substantially the same length, and one pair vertical and substantially the same length, the strips being adhesively secured to the face of the cover sheet to define a rectangular strike zone.

4. The device of claim 2 wherein the resilient pad is a composite pad comprising a central rectangular pad having the dimensions of a chosen strike zone, and a peripheral pad having a central opening into which the central pad is snugly fitted, the peripheral pad having a resilience different from that of the central pad.

5. The device of claim 4 wherein the peripheral pad has a resilience lower than that of the central pad.

6. The device of claim 2 wherein the backstop has a flexural modulus determined by ASTM D-790 in the range from about 60 to 11,000 MPa (8.7 to $1596.5\times10^3$ psi) and a thickness less than 0.5 cm (0.2"); the resilient pad is a homogeneous closed cell or open cell foam of an elastomer and has a hardness in the range from about Shore OO 15 to 95 (ASTM D-2240).

7. The device of claim 6 wherein first and second strike zones are identified on strike zone overlapping one another, with strips defining the overlap, each strike zone being visually defined by different strips, one set of strips differentiating a first strike zone from a second, so as to easily distinguish a "strike" or a "ball" for batters of different heights.

8. The device of claim 1 having a weight in the range from 5–15 Kg (11–33 lb).

9. A method for making a portable target for use as a passive pitching device by a pitcher pitching a baseball, comprising, removably securing a resilient pad to a resilient, flexible, pitch-indentable laminar backstop of man-made material having front and rear faces, the resilient pad having the same height and width dimensions as the backstop, the pad's resilience being measured as compressive pressure required to make an indentation 25% of the thickness of the pad, the pressure being in the range from 13.8–344.5 KPa (2–50 psi) and thickness in the range from about 0.2 cm (0.08 in) to about 4 cm (1.57 in), the backstop being momentarily pitch-indentable by a baseball at a velocity of 100 km/hr (62 mph);

covering the resilient pad with a resilient synthetic resinous cover sheet and folding margins of the cover sheet around the backstop's edges to form a rectangular free-standing laminate having height and width dimensions at least 20% greater than corresponding dimensions of a chosen strike zone and no dimension of the laminate greater than about 1.52 meters (60 ins), the cover sheet having a thickness in the range from 254 $\mu$m to 1524 $\mu$m (10 mils to 60 mils);

the cover sheet overlying the resilient pad in surface-to-surface contact with a predetermined tension so as to directly transfer force of the baseball impacting the cover sheet to the resilient pad and backstop;

and the cover sheet having a visually identifiable strike zone thereon;

pivotably connecting a support member to the target near the top thereof, the support member including a pair of legs terminal portions of which, when folded against the backstop fail to extend beyond the lower edge thereof, the logs adapted to contact the ground at locations spaced apart from each other and spaced apart from each lower corner of the target;

disposing the target's face at an angle relative to the pound, placing the laminate's lower edge in contact with the ground and adjusting the legs to present the exposed face of the cover sheet of she target at an obtuse angle in the range from about 100° to about 140°;

whereby a baseball pitched against the target at a velocity of about 100 km/hr (62 mph) pitch-indents the backstop is returned to a desired location in the range from about 2 m (6.5 ft) to about 15 m (49 ft) from the target without the target being moved from its location on the ground.

* * * * *